US009279319B2

(12) United States Patent
Savage

(10) Patent No.: US 9,279,319 B2
(45) Date of Patent: Mar. 8, 2016

(54) APPARATUS AND METHOD FOR PLACEMENT OF DOWNHOLE TOOLS USING A VISUAL IMAGING DEVICE

(76) Inventor: James M. Savage, Ragley, LA (US)

( * ) Notice: Subject to any disclaimer, the term of this patent is extended or adjusted under 35 U.S.C. 154(b) by 625 days.

(21) Appl. No.: 13/603,665

(22) Filed: Sep. 5, 2012

(65) Prior Publication Data

US 2013/0056278 A1 Mar. 7, 2013

Related U.S. Application Data

(60) Provisional application No. 61/573,373, filed on Sep. 6, 2011.

(51) Int. Cl.
*E21B 7/06* (2006.01)
*E21B 47/00* (2012.01)

(52) U.S. Cl.
CPC ..... *E21B 47/0002* (2013.01); *E21B 7/061* (2013.01)

(58) Field of Classification Search
CPC ..... E21B 47/0002; E21B 7/061
See application file for complete search history.

(56) References Cited

U.S. PATENT DOCUMENTS

| | | | | |
|---|---|---|---|---|
| 1,804,819 | A * | 5/1931 | Spencer, Jr. et al. | 175/81 |
| 2,136,748 | A * | 11/1938 | Lottinger | 175/45 |
| 2,778,603 | A * | 1/1957 | McCune et al. | 175/314 |
| RE33,660 | E * | 8/1991 | Jelsma | 175/107 |
| 5,697,445 | A * | 12/1997 | Graham | 166/313 |
| 6,220,372 | B1 * | 4/2001 | Cherry | 175/81 |
| 2009/0166035 | A1 * | 7/2009 | Almaguer | 166/254.1 |

* cited by examiner

*Primary Examiner* — Giovanna C Wright

(57) ABSTRACT

A method of orienting depth and direction (azimuth) of a guide device used to direct tools for the creation of a lateral borehole extending from a wellbore in an earthen formation, utilizing a visual imaging tool. The method including running a tool string into a wellbore, the tool string comprising a guide device and a visual imaging device, visually imaging the wellbore at a range of depths and orientations in the wellbore, and aligning the guide device within the wellbore in preparation of drilling tools to be used for the creation of a lateral borehole in an earthen formation.

12 Claims, 7 Drawing Sheets

APPARATUS AND METHOD FOR PLACEMENT OF DOWNHOLE TOOLS USING A VISUAL IMAGING DEVICE

CROSS-REFERENCE TO RELATED APPLICATIONS

The present application claims priority to U.S. Provisional Application No. 61/573,373 filed on Sep. 6, 2011.

FIELD

The present invention relates to an apparatus and method for placement of downhole tools and/or wellbore components within a wellbore utilizing a visual imaging device. More specifically, the invention relates to an apparatus and method for placement of downhole tools and/or wellbore components within a wellbore utilizing a visual imaging device to facilitate mechanically cutting earthen formation surrounding the wellbore, and optionally, casing and/or cement disposed in the wellbore, through the use of a rotatable, mechanical cutting head assembly.

BACKGROUND

A multitude of wells have been drilled into earth strata for the extraction of oil, gas, and other material there from. In many cases, such wells are found to be initially unproductive, or may decrease in productivity over time, even though it is believed that the surrounding strata still contains extractable oil, gas, water or other material. Such wells are typically vertically extending holes including a casing usually of a mild steel pipe having an inner diameter of from just a few inches to over eight inches used for the transportation of the oil, gas, or other material upwardly to the earth's surface. In other instances, the wellbore may be uncased at the zone of interest, commonly referred to as an "openhole" completion.

In an attempt to obtain production from unproductive wells and increase production in under producing wells, methods and devices for forming a hole in a well casing, if present, and forming a lateral passage there from into the surrounding earth strata are known. For example, a hole in cased wells can be produced by punching a hole in the casing, abrasively cutting a hole in the casing, milling a hole in the casing wall or milling out a vertical section of casing. While more or less efficacious, such methods are generally familiar to those in the art. In openhole wells, the steps to form a hole in the casing are not required, but the methods for forming a lateral passage into the surrounding strata may be virtually identical to those used on cased well.

Under both the cased and uncased well scenarios, a type of whipstock is typically incorporated to direct the cutting head out of the wellbore and into the formation. The whipstock may be set on the end of production tubing. Because of the time and economic benefits, often the cutting tools are run on the end of coiled tubing. In at least one known conventional horizontal drilling method using coiled tubing, the cutting tool completes its transition to the horizontal direction over a radius of at least several feet and some methods require a radius of over 100 feet. The size of the radius stems primarily from the length and diameter of the cutting tools and the rigidity of the toolstring that must transition around the radius. Other known methods for creating horizontal drainage tunnels are able to transition a much tighter radius (e.g., within 4.5" casing) by not attempting to pass relatively long and/or large diameter tools (e.g., a mud motor) outside of the wellbore. Instead most such methods utilize a flexible jetting hose with a specialized and relatively small nozzle head (e.g., less than a few inches long). Such methods may be efficacious, but typically suffer from a common problem that that they do not and/or cannot provide adequate torque to satisfactorily power a mechanical cutting means capable of cutting harder formation. Accordingly, these methods may be limited only to very soft formations.

In some instances, greater efforts are being expended at producing thinner, laminated reservoirs that may not have been produced in the past. Further, older, abandoned reservoirs are being reworked using enhanced oil recovery (EOR) and other techniques to extract as much remaining oil and gas as possible in contrast to past practices where such an older well may have been simply abandoned. To meet the requirements of today's more complex oil and gas recovery methods, more specifically, short radius horizontal drilling, there is a growing need to obtain real-time visual imaging of the amount of hydrocarbons being produced through perforations in the casing of a cased-hole completion or simply from the formation in an openhole completion. The imaging purpose is to guide, steer, position and orient short radius horizontal drilling tools after capturing the images, and without removing the tool string, to include the visual imaging device, from the borehole, proceed to perform the short radius drilling operation. The apparatus purpose is also to only run in hole the imaging device one time thereby reducing the amount of time on location and reduce the costs associated with running in and pulling out of the hole.

One aspect of utilizing a whipstock with downhole tools to the placement of the whipstock and the tools that will be used to form the lateral borehole extending into the formation. The placement, both the depth and axially is important to direct the cutting head out of the wellbore and into the formation of interest and can be assisted with the use of a visual imaging device. The visual imaging device can be used to locate and position the whipstock at the optimal depth and/or azimuth of the formation of interest so as to guide, steer, position and orient short radius horizontal drilling tools can enable production from thinner reservoirs that heretofore have not been developed.

In view of the above, it would be desirable to have a the ability to locate and position a whipstock at an optimal depth and/or azimuth of the formation of interest to guide, steer, position and orient short radius horizontal drilling tools to produce lateral boreholes into a formation of interest. It would further be desirable to have a cutting system capable of locating a whipstock and other tools such as a cutting tool in a wellbore to precisely position such tools with the aid of a visual imaging device.

SUMMARY

An embodiment of the present invention is a method of orienting depth and direction (azimuth) of a guide device used to direct tools for the creation of a lateral borehole extending from a wellbore in an earthen formation, utilizing a visual imaging tool. The method including running a tool string into a wellbore, the tool string comprising a guide device and a visual imaging device, visually imaging the wellbore at a range of depths and orientations in the wellbore, and aligning the guide device within the wellbore in preparation of drilling tools to be used for the creation of a lateral borehole in an earthen formation.

DETAILED DESCRIPTION

Figure 1:
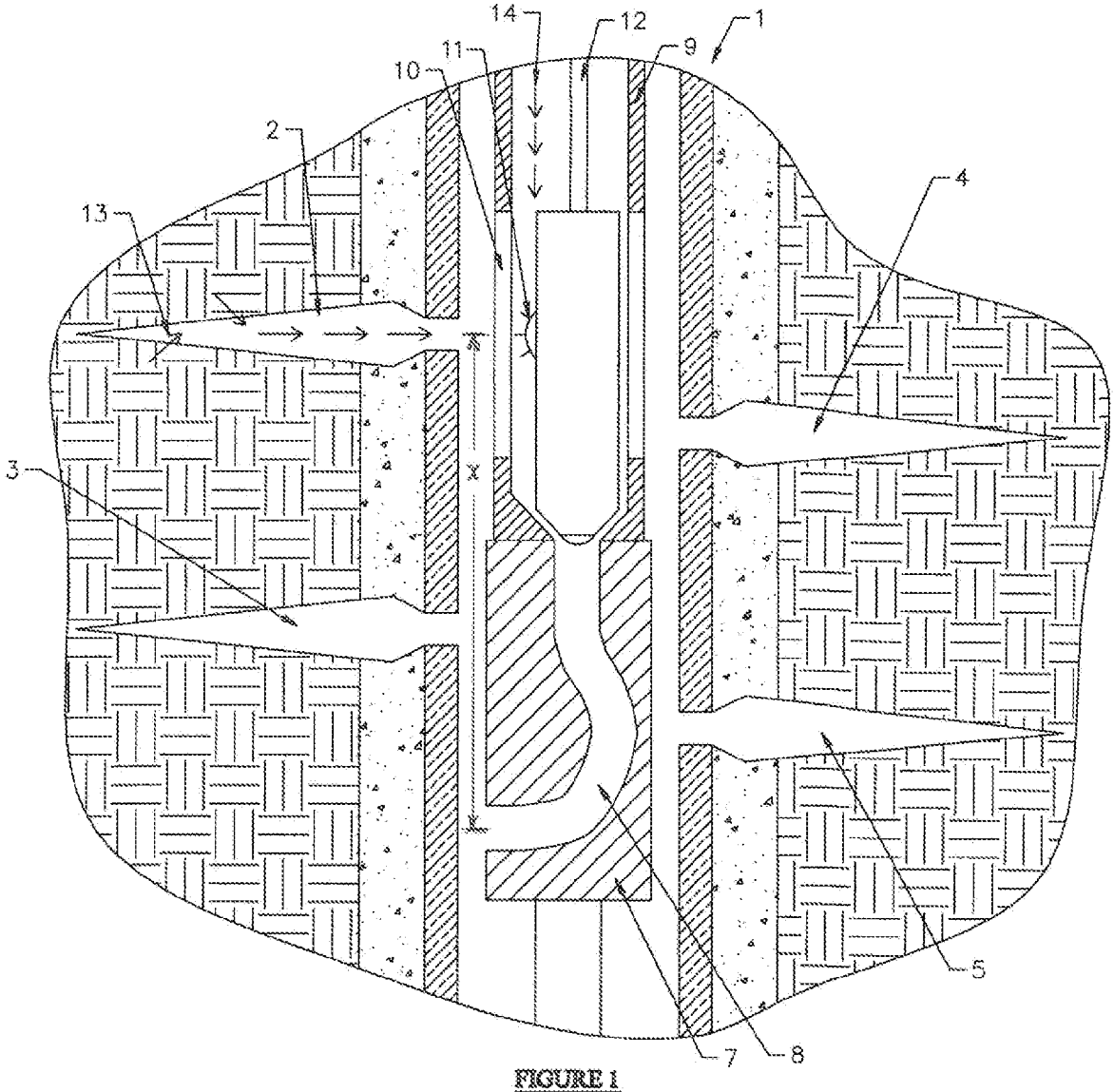
FIG. 1 illustrates a cross-sectional view of a cased wellbore containing a whipstock and a visual imaging tool in conjunction with an embodiment of the present invention.

In an aspect of the current invention, an apparatus for locating a whipstock or other downhole tool within a wellbore utilizing a visual imaging device is provided. The whipstock and visual imaging device can be used for cutting laterally into an earthen formation from a wellbore. As used herein, the term "lateral" or "laterally" refers to a borehole deviating from the wellbore and/or a direction deviating from the orientation of the longitudinal axis of the wellbore such that the borehole is in a generally perpendicular alignment with the wellbore. The orientation of the longitudinal axis of the wellbore in at least one embodiment is vertical, wherein such a wellbore will be referred to as a vertical wellbore or substantially vertical wellbore. However, it should be understood that the orientation of the longitudinal axis of the wellbore may vary as the depth of the well increases, and/or specific formations are targeted. As used herein, the term "strata" refers to the subterranean formation also referred to as "earthen formation." The term "earthen formation of interest" refers to the portion of earthen formation chosen by the operator for lateral drilling. Such earthen formation is typically chosen due to the properties of the formation relating to hydrocarbons.

In an embodiment the present invention relates to an apparatus, system, and method for cutting laterally into an earthen formation utilizing a visual imaging device. Optionally, the apparatus may be used for cutting laterally into cement disposed within the wellbore. Optionally, the apparatus may be used for cutting laterally into the casing and cement disposed in the wellbore. Utilizing a visual imaging device along with other apparatus to cut laterally through the casing, cement, and earthen formation is advantageous in that the number of trips of downhole can be reduced significantly. The visual imaging device may be used in cased wellbores or openhole wellbores. Optionally, the visual imaging device may be used in wellbores wherein the one or more hole may have already been created through the casing and/or cement.

Generally, the visual imaging device and whipstock will be run to a depth in the wellbore suitable for the retrieval of hydrocarbons and/or other desired materials. The location of the lateral boreholes will be operator specific and may vary based on the needs and goals of the operator. The location of the lateral boreholes may also be determined utilizing the visual imaging device and whipstock to determine an optimum location of the lateral borehole and the environmental properties of the surrounding strata.

In at least one embodiment, the apparatus is a downhole tool assembly including a visual imaging device, a whipstock, a cutting head assembly, a flexible tubular shaft member, and a drive linkage attached to a means of rotation. When in use in a wellbore, the whipstock can be located as determined by the images received from the visual imaging device, the downhole tool assembly can be connected to a spool assembly including a conduit that can be used to lower and/or rotate the downhole tool assembly inside the wellbore. The downhole tool assembly may be connected to a fluid motor and coiled tubing or jointed tubing or pipe, that can be lowered into a wellbore and operated so as to locate and fix the whipstock to place the cutting head in a desired location and/or orientation by use of the visual imaging device, then cause rotation of the drive linkage and cutting head for the formation of a lateral borehole. The whipstock, is spaced at a known distance and direction from the visual imaging device which enables placement in the desired location and/or orientation. In another embodiment, the downhole tool assembly is operatively connected to pumping equipment and a slickline or e-line unit, which together allow for placement, operation and/or retrieval of the downhole tool assembly utilizing the visual imaging device. In an embodiment, the downhole tool assembly including visual imaging device is operatively connected to pumping equipment and tubulars that together can be used to control the operation of the downhole tool assembly.

Turning now to a system and method for cutting laterally into an earthen formation from a wellbore, a whipstock is employed in at least one embodiment of the present invention utilizing a visual imaging device that is part of the whipstock or located adjacent to the whipstock. As used herein, the term "whipstock" refers to any downhole device capable of positioning the cutting head assembly toward the earthen formation desired for lateral cutting. The whipstock defines a guide channel sized and configured to receive and guide the cutting head assembly, drive linkage, and at least a portion of the flexible tubular shaft member through the whipstock and proximate the earthen formation of interest. In at least one embodiment, the whipstock may guide the cutting head assembly into a substantially horizontal direction from a vertical wellbore such that the cutting head assembly is disposed approximately 90 degrees from the longitudinal axis of the wellbore. Optionally, the whipstock may be set with a coil tubing unit, on the end of production tubing or it may be set by a wireline unit. The whipstock may have one or more passageways running through it that allow cuttings from the lateral borehole to fall toward the bottom of the wellbore.

In an embodiment wherein a whipstock is disposed in a wellbore, a coiled tubing and pumping equipment can be connected to the upper end of the tool string such that fluid pumped through the coiled tubing can drive a fluid motor and the attached drive linkage and cutting head assembly. The fluid is circulated through the motor, drive linkage and the cutting head assembly and provides a means for rotational motion of the drive linkage and the cutting head assembly. Now under rotation, the drive linkage and attached cutting head can be directed out of the wellbore by the pre-positioned whipstock, with aid of the visual imaging device, in order to cut a lateral borehole in the surrounding earthen formation. The fluid circulated through the cutting head assembly further provides a means for removing cuttings from the lateral borehole via fluid flow between the flexible tubular member and the lateral borehole. The cutting head assembly can contain one or more nozzle defining one or more openings in fluid communication with the inner passageway. The fluid circulated through the cutting head assembly can be emitted through the one or more nozzle opening on the cutting head to facilitate the cutting of the lateral borehole. Optionally, the drive linkage and attached cutting head may be used to cut through the casing and cement, if present, and proceed to cut into the surrounding earthen formation. The lateral borehole can be formed through a preexisting hole in the casing that was created from milling out a section of casing, abrasively cutting the casing, punching a hole through the casing, cutting a hole through the casing, using a chemical to erode the casing, or any other means or combination thereof, as is generally familiar to those who practice the art.

Turning now to the Figures, FIG. 1 is a cross-sectional view of a perforated cased wellbore (1) with perforations (2, 3, 4 and 5) in a general zone of interest (6). A guide device, shown as a whipstock (7), with a guide channel (8) to direct a tool string (not shown), affixed to upset tubing (9) is positioned in the zone of interest (6). A viewing window (10) in the upset tubing (9) allows a side-view downhole visual imaging device (11), in this case conveyed on an e-line (12), to scan the perforations (2, 3, 4 and 5) to determine the optimal location of inflow shown by arrows (13) and hence allow for repositioning of the whipstock (7) to that precise location. The whipstock (7), is spaced at a known distance (x) and direction from the visual imaging device (11) which enables placement in the desired location and orientation. Clear fluid, as shown by arrows (14), is being pumped down the upset tubing (9) to allow for a clearer imaging of the downhole environment.

Figure 2:
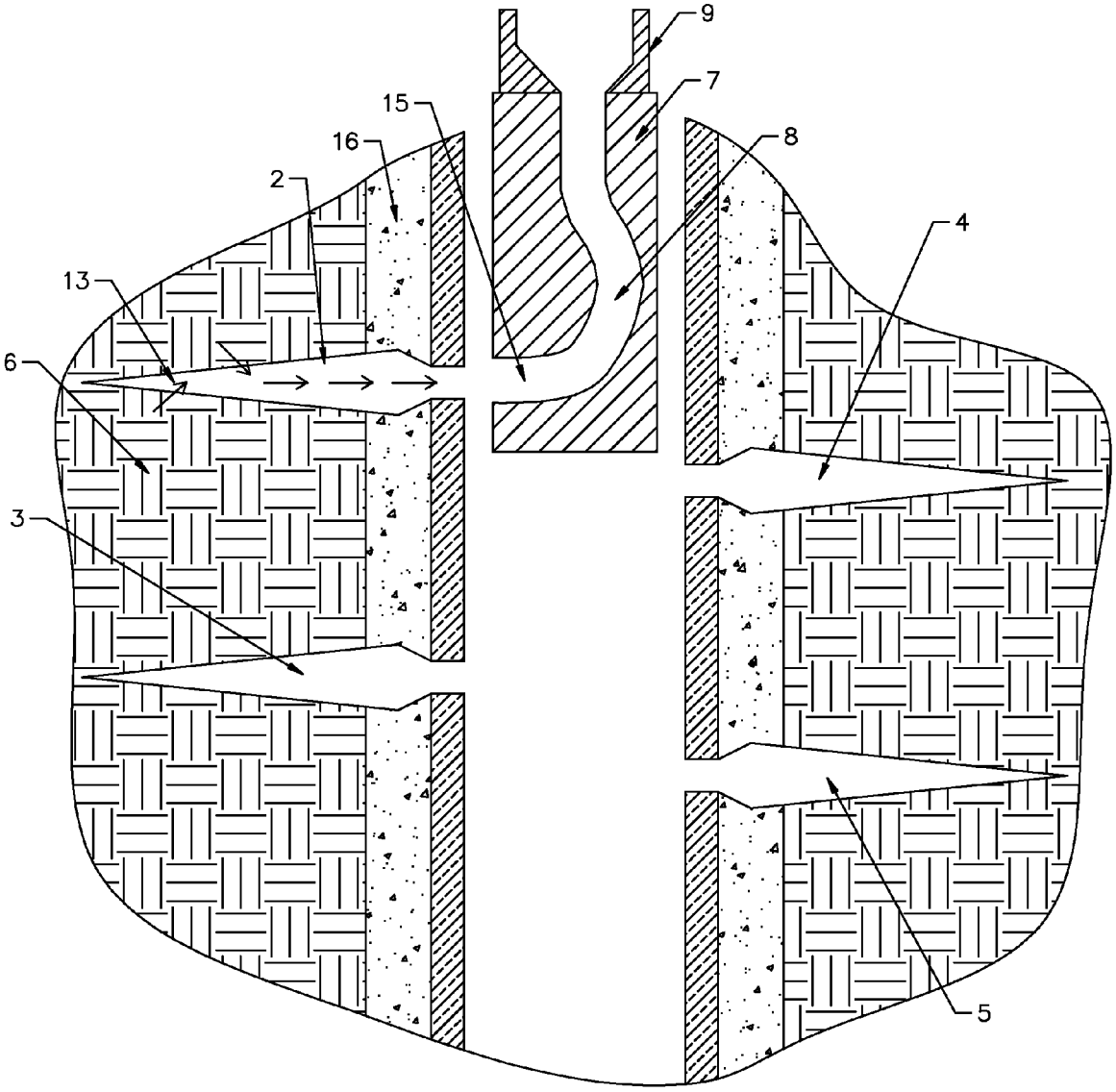
FIG. 2 illustrates a cross-sectional view of a cased wellbore containing a whipstock, deployed in the wellbore and is disposed to facilitate the drilling of a lateral borehole thru a predefined hole in wellbore casing.

FIG. 2 is a cross-sectional view of a perforated cased wellbore (1) with perforations (2, 3, 4 and 5) in a general zone of interest (6). The visual imaging device (not shown) helped identify that perforation (2) was the optimal location of inflow shown by arrows (13) and hence allowed for the guide device, shown as a whipstock (7), with a guide channel (8) to direct a tool string (not shown), affixed to upset tubing (9) is positioned in the zone of interest (6) at the precise position. The selected tool string (not shown) can be lowered through the production tubing (9) and guided into the guide channel (8) of the whipstock (7) and the tool string (not shown) can exit the whipstock (7) at the lower opening (15) of the guide channel (8) allowing the tool string (not shown) to engage the casing (1), the cement (16) and eventually the formation or zone of interest (6) in an advantageously productive area as determined by the data from the visual imaging device (not shown) for the purpose of creating a borehole into the zone of interest (6).

Figure 3:
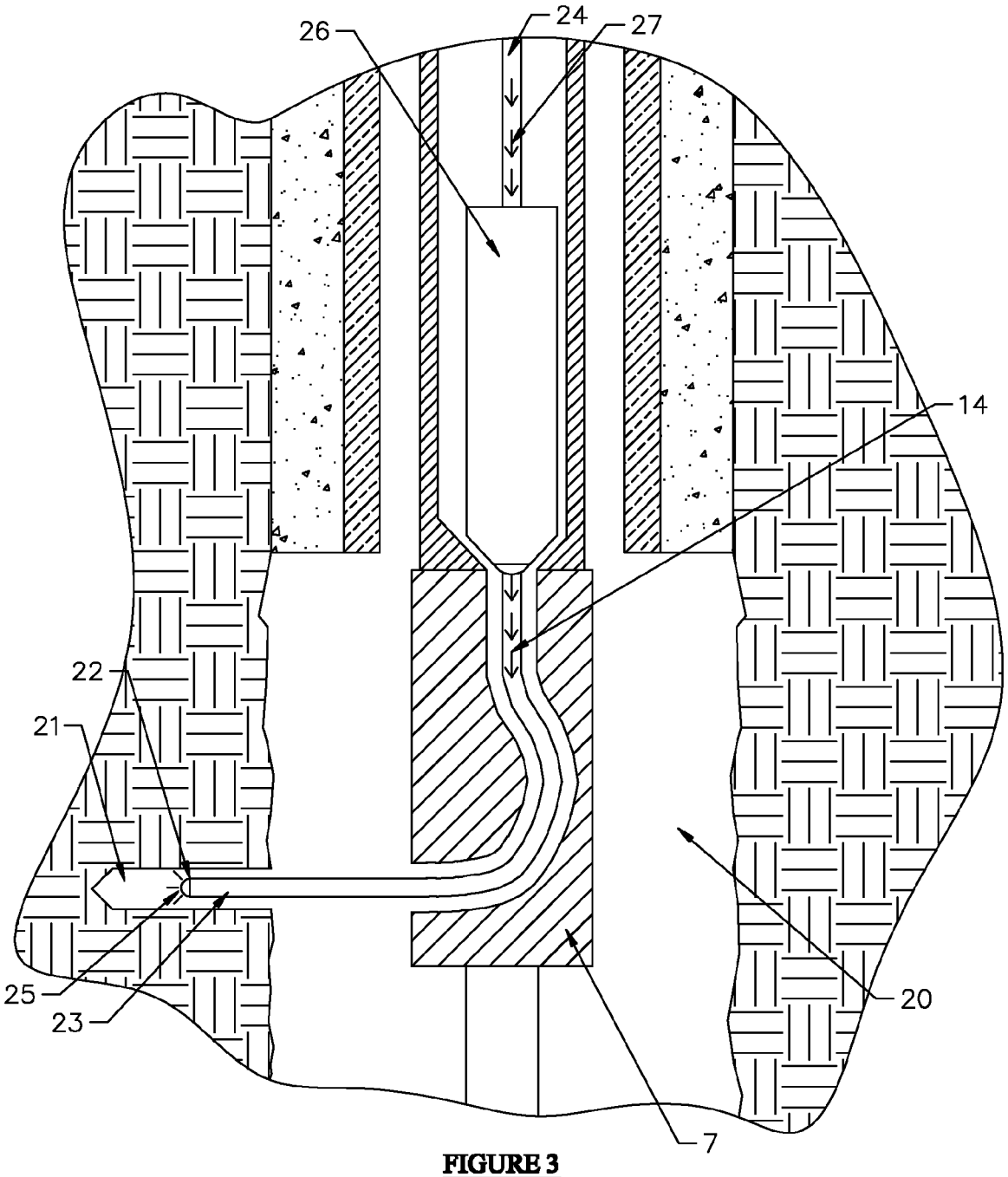
FIG. 3 illustrates a cross-sectional view of a open-hole wellbore containing a whipstock, wherein a visual imaging tool is deployed in the wellbore, guided through a guide channel in the whipstock, and into a lateral borehole into the earthen formation of interest.

FIG. 3 is a view of an openhole completed wellbore (20) with a whipstock (7), positioned about a recently created lateral borehole (21) that is generally perpendicular to the wellbore (20). In this case, part of a flexible borescope (22) has been positioned inside a hose (23), both of which have been conveyed on coiled tubing (24). Fluid (14) is being pumped down the coiled tubing (24) and out of the hose (23) so that a clear image of the lateral borehole (21) can be imaged. An illumination device (25) at the end of the borescope (22) is providing illumination of the lateral borehole (21). The electronics module for the borescope is positioned in the upset tubing in a special sub (26) that and allows for fluid (27) to be pumped to the hose containing the borescope.

Figure 4:
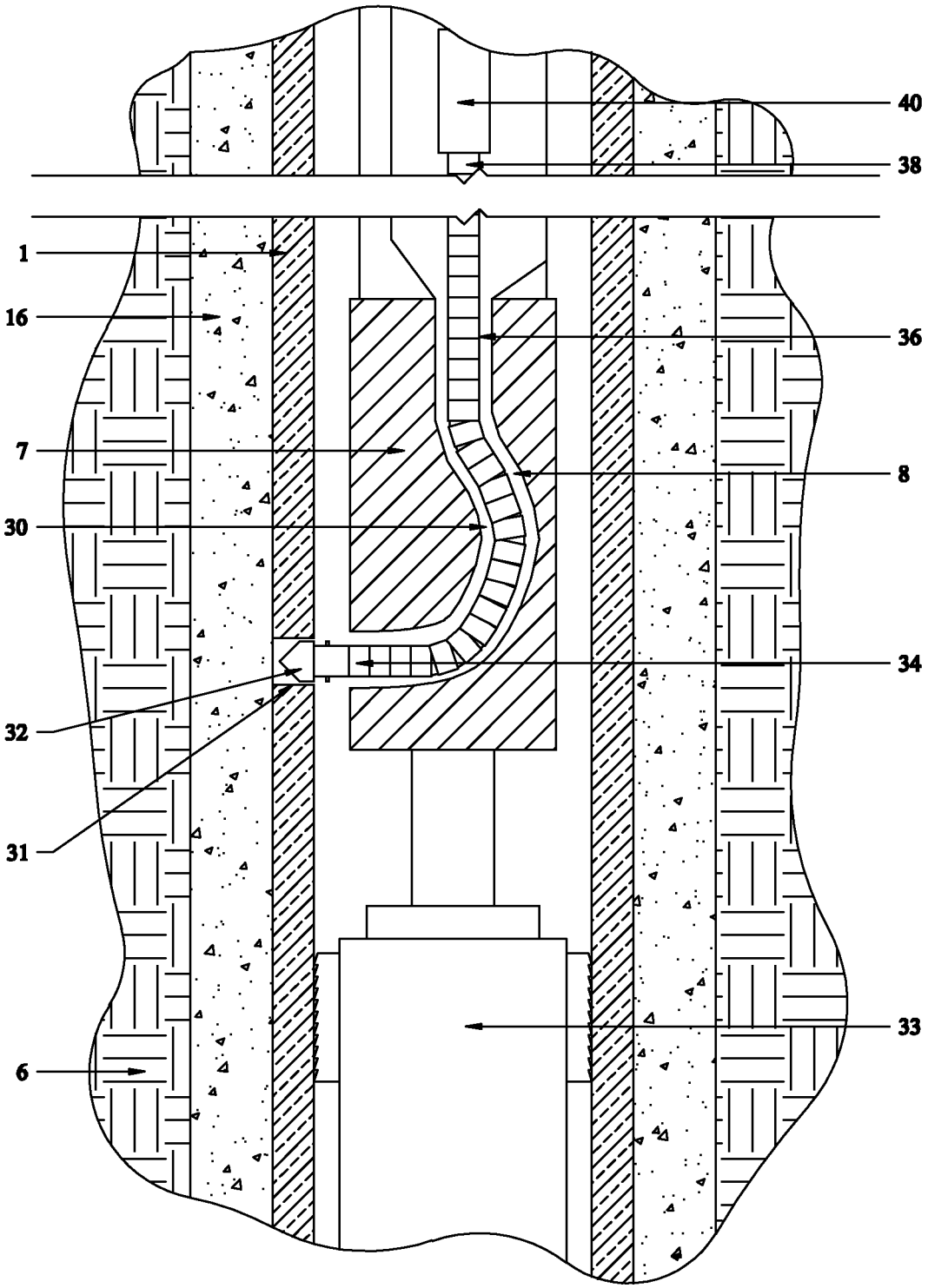
FIG. 4 illustrates a cross-sectional view of a cased wellbore containing a whipstock, after positioning with a visual imaging tool, and drilling tools to create a lateral borehole into the earthen formation of interest.

Looking now at FIG. 4, illustrated is a portion of the downhole tool assembly (30) that has been guided through the guide channel (8) defined by a whipstock (7) positioned on a packer (33) with the aid of the visual imaging tool (not shown). The cutting head (34) of the downhole tool assembly (30) is disposed in a pre-defined opening (31) in a portion of the casing (1) proximate the cement (16) and formation (6). The first end portion (38) of the flexible tubular shaft (36) is operatively coupled to a rotational source (40) while the second end portion (34) of the flexible tubular shaft (36) is connected to a cutting head assembly (32). When activated, the motor (40) applies torque to the flexible tubular shaft (36), which has been sized and configured to transfer the torque to the cutting head assembly (32), thereby enabling cutting of the cement (16) and earthen formation (6).

Figure 5A:
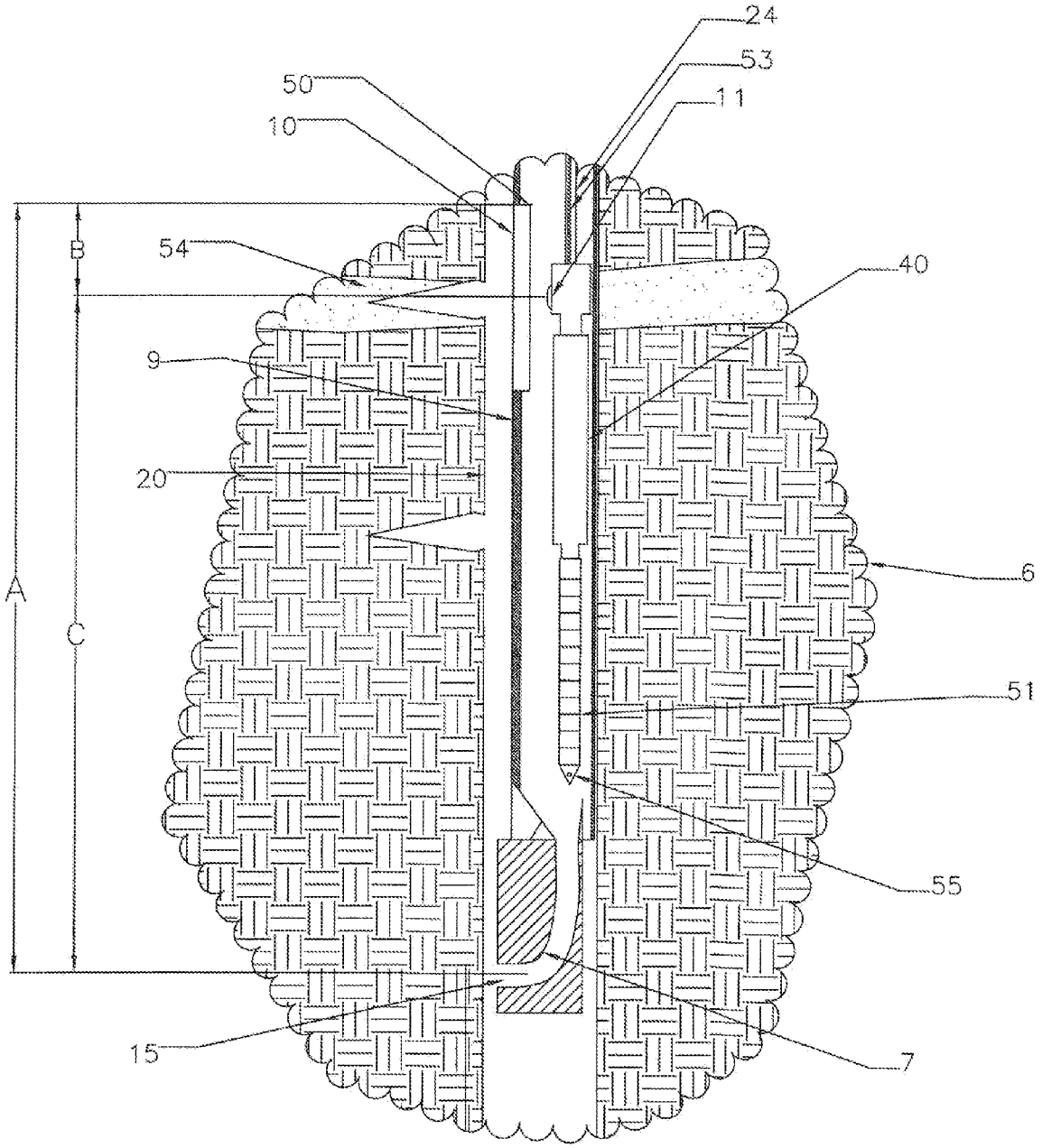
FIGS. 5*a* and 5*b* illustrate examples where a tool-string containing the guide device (or whipstock) is repositioned by virtue of an imaging tool that is part of another downhole toolstring that is also used to cut into the formation.

In FIG. 5*a*, one can see an open hole completed wellbore (20) with a whipstock (7) positioned in a zone of general interest (6). A viewing window (10) with a top of the viewing window (50) is positioned along upset tubing (9). The top of the viewing window (50) is a known distance (distance A) above the whipstock (7). An imaging device (11) is positioned above a motor (40), which serves as part of a formation drilling toolstring (51). The imaging device (11) is connected to an electrical conductor line (53) positioned inside of coiled tubing (24). The imaging device (11) has identified a specific zone of interest (54), which is a known distance (B) down from the top of the viewing window (50). By subtracting the known distance A from the known distance B, the operator can identify how far (distance C) they must move the upset tubing (9) up the open hole completed wellbore (20) to properly position the whipstock (7) at the specific zone of interest (54).

Figure 5B:
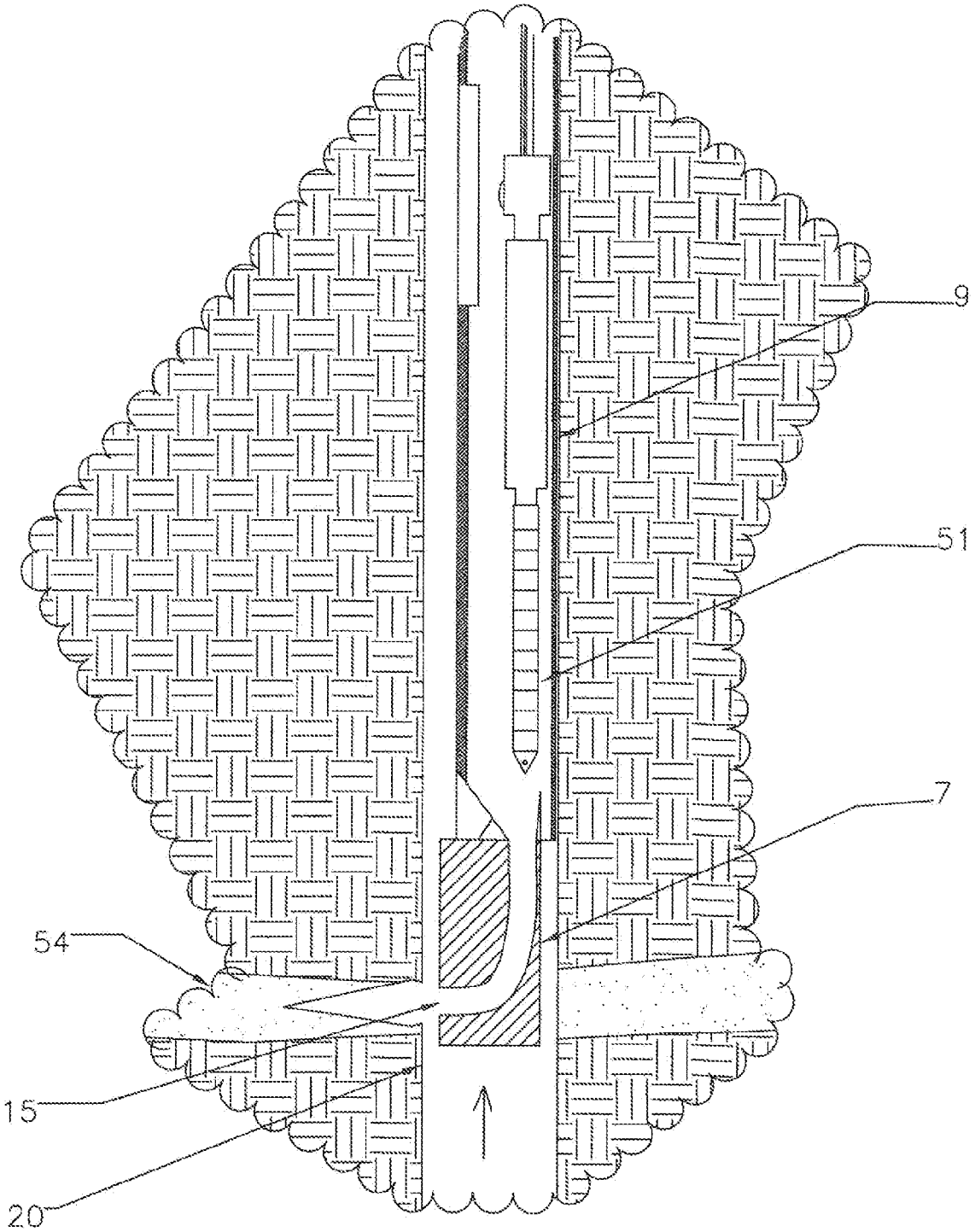

In FIG. 5*b*, the whipstock (7) has been positioned in the open hole completed wellbore (20) has been repositioned by vertically manipulating the upset tubing (9) distance C. As such, the lower opening (15) of the whipstock (7) is now ideally positioned at the specific zone of interest (54) and the formation drill string (51) with nozzle orifice (55) positioned about can now be activated to drill a lateral at the ideal depth.

Figure 6:
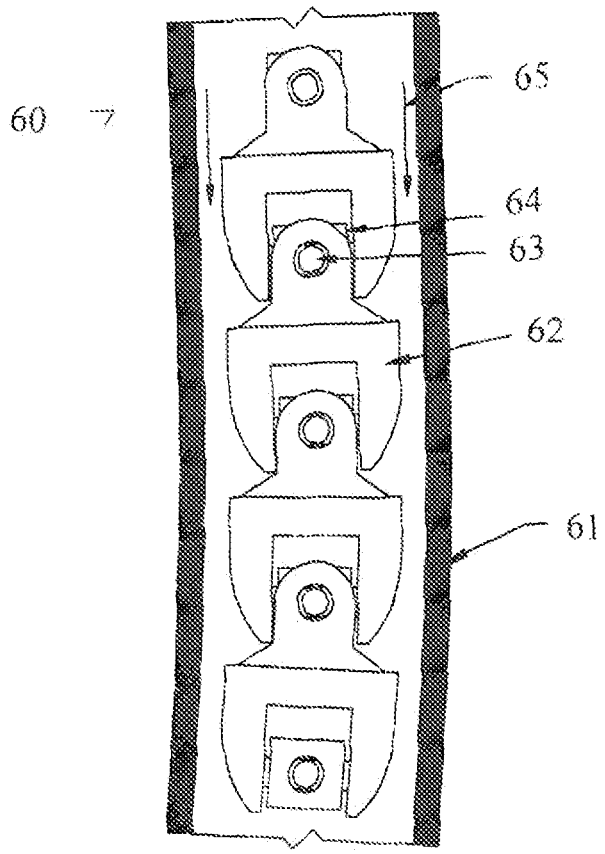
FIG. 6 illustrates an example of a portion of a drilling tool that includes a flexible tubing that is circumscribing a series of interconnected drive segments.

FIG. 6 is a view of a portion of a drilling tool (60) that includes a flexible tubing (61) circumscribing a series of interconnected drive segments (62). The drive segments (62) can be connected by a pin (63) and swivel (64) or other suitable arrangement. The flexible tubing (61) circumscribing the interconnected drive segments (62) enables a flow of liquid (65) to be contained within the drilling tool (60).

As used herein, the term "hose" refers to elastomeric hose, single or multi-braided hose, sheathed hose, Kevlar® hose and comparable means of providing a means for fluid conduit.

As used herein, the term "fluid" refers to liquids, gases and/or any combination thereof.

Use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, etc.

Depending on the context, all references herein to the "invention" may in some cases refer to certain specific embodiments only. In other cases it may refer to subject matter recited in one or more, but not necessarily all, of the claims. While the foregoing is directed to embodiments, versions and examples of the present invention, which are included to enable a person of ordinary skill in the art to make and use the inventions when the information in this patent is combined with available information and technology, the inventions are not limited to only these particular embodiments, versions and examples. Other and further embodiments, versions and examples of the invention may be devised without departing from the basic scope thereof and the scope thereof is determined by the claims that follow.

What is claimed is:

1. A method of orienting depth and direction (azimuth) of a guide device used to direct tools for the creation of a lateral borehole extending from a wellbore in an earthen formation, comprising:

running a tool string into a wellbore, the tool string comprising a guide device and a visual imaging device;

visually imaging the wellbore at a range of depths, while rotating the visual imaging device to observe a view of at least 90 degrees at a range of depths in the wellbore;

aligning the guide device within the wellbore in preparation of drilling tools to be used for the creation of a lateral borehole in an earthen formation wherein the lateral borehole is generally perpendicular to the wellbore.

2. The method of claim 1, further comprising adjusting the depth of the downhole tool string, and thus the imaging device, to view the wellbore.

3. The method of claim 1, wherein the visual imaging device is a visual imaging device or video visual imaging device used to position the guide device via upset tubing, coiled tubing, wireline, slickline or other carrying method.

4. The method of claim 1, wherein the guide device may be positioned within the wellbore on a resettable packer with an exit hole, viewing window or kick-off point used to direct and guide the drilling tools.

5. The method of claim 1, wherein the guide device is spaced at a known distance and direction (azimuth) from the visual imaging device.

6. The method of claim 1, utilizing a real-time or near real-time visual imaging device feed to determine the target location and then repositions the guide device with the imaging device still in the wellbore.

7. A method of drilling a lateral borehole extending from a wellbore in an earthen formation, comprising:

running a tool string into a wellbore, the tool string comprising a guide device, a visual imaging device, a flexible tubular member, and a cutting head assembly; the flexible tubular member comprising a flexible tubing circumscribing a series of interconnected drive segments forming at least one inner passageway, the flexible tubular member being sized and configurable such that the cutting head assembly is attached to the series of interconnected drive segments and is in fluid communication with the at least one tubular member inner passageway;

visually imaging the wellbore at a range of depths, to determine a desirable depth and alignment of the guide device;

aligning the guide device within the wellbore;

running the flexible tubular member through the guide device and locating the cutting head assembly adjacent to the earthen formation to be drilled;

rotating the interconnected drive segments to transmit rotation and torque to the cutting head assembly;

circulating fluid through the at least one inner passageway to provide fluid to the cutting head assembly and circulating said fluid through the cutting head;

drilling of a lateral borehole in the earthen formation by rotational movement of the cutting head assembly and interconnected drive segments;

removing cuttings from the lateral borehole via circulating fluid flow between the flexible tubular member and the lateral borehole.

8. The method of claim 7, wherein the a flexible tubular member is operatively connected to a rotational source and the rotational source is coupled to a conduit, such that the conduit, rotational source, and a flexible tubular member are in fluid communication;

activating the rotational source, wherein a torque is applied to the interconnected drive segments; and translating the torque to the cutting head, wherein the torque causes the cutting head to rotate.

9. The method of claim 7, wherein the tool string further comprises a nozzle on the cutting head defining one or more openings in fluid communication with the inner passageway, wherein the method further comprises:

pumping one or more fluids through the at least one inner passageway; and emitting the pumped fluid from the nozzle openings on the cutting head.

10. The method of claim 7, wherein fluid is pumped through a fluid motor so as to rotate the flexible tubular member and the cutting head so as to cut the earthen formation.

11. The method of claim 7, further comprising forming a lateral borehole through a pre-existing hole in a casing.

12. The method of claim 7, further comprising forming a hole through a wellbore casing and drilling through any adjacent cement and into the earthen formation.

* * * * *